United States Patent [19]

Binder

[11] 4,121,577

[45] Oct. 24, 1978

[54] METHOD AND APPARATUS FOR AIDING CONDITIONING OF AN ERECT SPINAL COLUMN AND ADVANTAGEOUS MUSCLE CONTROL

[76] Inventor: Timothy A. Binder, 3704 Wonderland Hill, Boulder, Colo. 80302

[21] Appl. No.: 755,998

[22] Filed: Jan. 3, 1977

[51] Int. Cl.[2] ..... A61F 5/00

[52] U.S. Cl. ..... 128/69; 35/29 D

[58] Field of Search ..... 128/24 R, 25 R, 68, 128/69; 35/29 R, 29 D, 29 E; 272/125, 126, 144

[56] References Cited

U.S. PATENT DOCUMENTS

| | | | |
|---|---|---|---|
| 32,014 | 4/1861 | Taylor | 128/69 |
| 497,774 | 5/1893 | Denison | 272/126 |
| 786,672 | 4/1905 | Pfund | 128/25 R |
| 904,815 | 11/1908 | Sletto | 128/25 R |
| 1,347,913 | 7/1920 | Rink | 128/69 |
| 1,508,892 | 9/1924 | Mikalsen | 272/126 |

FOREIGN PATENT DOCUMENTS

| | | | |
|---|---|---|---|
| 582,524 | 12/1976 | Switzerland | 128/69 |

*Primary Examiner*—Lawrence W. Trapp
*Attorney, Agent, or Firm*—Gary M. Polumbus

[57] ABSTRACT

A handgrip member and back reference bar are part of an improved apparatus for aiding conditioning of muscles in th head and neck, the shoulder girdle and the pelvic girdle to position those body parts in relation to a centerline or gravity line through an erect individual to improve the posture of the individual through an erect spinal column. With the improved apparatus, certain key muscles and various body manipulations are used in conditioning an erect spinal column and in conditioning advantageous muscle control prevalent in a cross-crawl movement by the method of the invention.

21 Claims, 13 Drawing Figures

METHOD AND APPARATUS FOR AIDING CONDITIONING OF AN ERECT SPINAL COLUMN AND ADVANTAGEOUS MUSCLE CONTROL

BACKGROUND AND SUMMARY OF THE INVENTION

This invention relates to an improved apparatus and method for aiding the conditioning or teaching of proper posture or an erect body position of an individual person, and for aiding transferring of muscle control prevalent in a cross-crawl movement to the erect biped or standing position of an individual. The invention helps the individual change his or her braced S-curved spinal configuration to a generally erect and aligned spinal column having the characteristic of an off-center segmented column. The present invention is useful in giving the individual reference focuses for relating the head and neck, all of the spine, and the shoulder and pelvic girdles properly in relation to one another and to a centerline through an erect or standing body. As will appear hereinafter, this centerline is generally defined by a vertical gravity line through an erect body extending through the ankle, knee, hip, and elbow joints, the shoulder, and the head and neck at the first cervical vertebrae and at the posterior portion of the jaw. An erect spinal column places the various body parts and organs in a mutually beneficial relationship in the earth's gravity, resulting in a more healthful condition of the person's body in a position of balance and equilibrium with its environment. Conditioning of the erect spinal column may occur in conjunction with aiding transferring muscle control of a cross-crawl movement on hands and knees into the movements of an erect individual with the properly aligned spinal column, for additional beneficial results.

In general, posture conditioning or teaching apparatus is known in the art. For example, U.S. Pat. No. 2,270,069 to Martin, issued Jan. 13, 1942, describes certain apparatus in relation to which the present invention is an improvement. Apparently, the only purpose of the Martin apparatus is aiding conditioning of the shoulder girdle to the thorax of the individual. It does not recognize the importance of correctly aligning the whole length of the spinal column in an erect body position, and does not disclose the aiding of transferring muscle control prevalent in a cross-crawl movement to the erect body position. Thus the Martin apparatus does not disclose means for aiding conditioning of the total length of the back or spinal column and specifically, there is no disclosure of means for aiding conditioning of the positions of the pelvic girdle, the head, neck and spine through a centerline or gravity line of an erect individual.

A cross-crawl movement of a child on hands and knees has long been recognized as instilling coordination, graceful movement and muscle control through its practice. Simulation of cross-crawl movements by adults also results in similar beneficial effects, but the inventor herein is not aware of any attempts to transfer this advantageous muscle control to the movements of adults in the standing or biped position.

It is, therefore, a general object of the invention to provide an improved apparatus and method for aiding conditioning of muscles controlling the head and neck, the shoulder girdle and the pelvic girdle in relation to one another, in relation to the back and spine, and in relation to a gravity line through the body to obtain proper posture as a result of an erect and aligned spinal column.

It is another general object of this invention to aid transferring of the muscle coordination and control prevalent in a cross-crawl movement on hands and knees into the movement of an erect or standing individual with proper posture and a properly aligned spinal column.

It is another object of this invention to provide an apparatus and method of aiding conditioning of the head and neck in relation to the thorax or the back or spinal column of an individual.

It is another object of this invention to provide an apparatus and method for aiding and conditioning of the pelvic girdle in relation to an erect spinal column and in relation to a centerline through the thorax and the body.

A further object of this invention is to provide improvements in apparatus for use in aiding conditioning of proper posture.

The inventive concepts involved in the apparatus may be generally summarized as comprising elbow support means for supporting an individual's bent elbows, shoulder engaging means for engaging the individual's shoulder fronts at a distance outward from the elbow support means, and handgrip means for gripping by the individual's hands at a position below the elbow support means. Back referencing means for engaging the individual's back below the shoulders may also be provided. The handgrip means and the back referencing means aid in conditioning the pelvic girdle position and the head, the neck, and all of the back or spinal column in relation to the shoulder girdle and pelvic girdle and the various parts of the spine itself for the purpose of changing the spinal column from an S-shaped curve braced mechanic configuration to a configuration of an off-center segmented and erect column. The inventive concepts involved in the method of the invention may be summarized as providing one or more of the previously described elements of apparatus for use in accomplishing body exercises to obtain an erect and aligned off-centered segmented spinal column. The body exercises comprise moving the head and neck by flexing the rectus capitus anterior muscles to generally move the head up and back from the shoulder girdle, moving the back and spinal column backward at the shoulder girdle by flexing the serratus magnus muscles, and moving the anterior superior iliac spines of the pelvic girdle back toward a centerline or gravity line by flexing the internal obliques and psoas muscles while gripping the handgrip means and pulling down on the handgrip means. For aiding transferring muscle control prevalent in a cross-crawl movement, the method of the invention may include steps of placing one foot transversely forward with respect to the other foot, supporting the majority of the weight on the backward foot, and accomplishing one or more of the foregoing method steps to obtain an erect and aligned spinal column.

Details of the present invention may be understood from the following appended claims, description of the preferred embodiment of the invention, and the brief description of the drawings.

DESCRIPTION OF A PREFERRED EMBODIMENT

Figure 9:
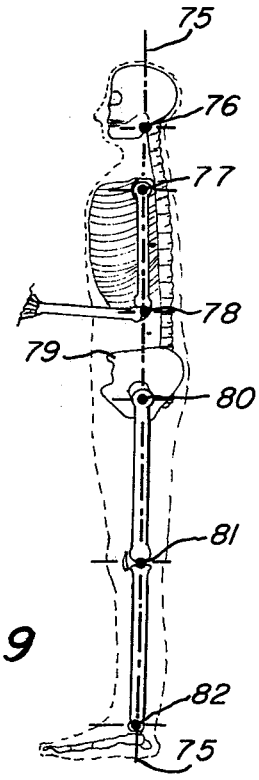
FIG. 9 is a schematic illustration of certain elements of a human skeleton illustrated in a position with a centerline running through certain of those elements to define the proper posture to be obtained in accordance with the present invention, and also illustrating the configuration of an off-center segmented and aligned spinal column.

Apparatus 20 for aiding conditioning of proper posture of an erect spinal column and for aiding transferring of muscle control prevalent in a cross-crawl movement to a standing or erect individual is shown in FIGS. 1 through 8. An explanation of the mechanics of an erect spinal column, the desired posture of the human body relative to a centerline or gravity line through certain body parts, and the key muscles used in moving the body parts to obtain the proper posture will secondly be described in conjunction with FIGS. 9 and 10. Lastly, the use of the apparatus 20 and the description of the method of the present invention will be discussed in conjunction with FIGS. 11 to 13.

The apparatus 20 generally comprises a rectangular frame member 21 of substantial contruction to support the various elements of apparatus 20 described herein. Means for attaching the frame member 21 and, as a result, the other elements of apparatus 20 to an upright surface such as a wall are provided in the form of brackets 22. Vertically extending slide members 24 are securely attached at each laterally opposite side of frame member 21. A mirror 25 is positioned by brackets 26 to the frame member 21 intermediate the vertically extending slide members 24, and the mirror extends vertically approximately the length of the frame member 21. When the apparatus 20 is attached on a wall at the wall corner, mirror 25 and other mirrors provide front and side views of the individual using the apparatus.

An adjustable carriage member 27 is adjustably retained in a vertical manner in each slide member 24. As can be better understood from FIG. 3, the adjustable carriage member 27 includes outward projecting extensions 30 having holes 31 therein for supporting a laterally extending pivot rod 32 therebetween. Pivot rod 32 is held in position by nuts 33 attached at its ends external of the extensions 30. Pivot rod 32 maintains a position outwardly spaced from the outer surface 34 of the carriage member 27 to allow various other elements of the apparatus to pivot thereabout, as are next described.

One elbow cup member 35 is attached to each pivot rod 32 of each carriage member 27. An upward portion 36 of each elbow cup member 35 is formed in a C-shaped cross section (FIG. 3) with two outwardly extending projections 37 having holes 38 formed therein for receiving pivot rod 32. The elbow cup members 35 may be laterally adjusted along the length of pivot rod 32 since the holes 38 are slightly larger in diameter than the diameter of rod 32.

Figure 2:
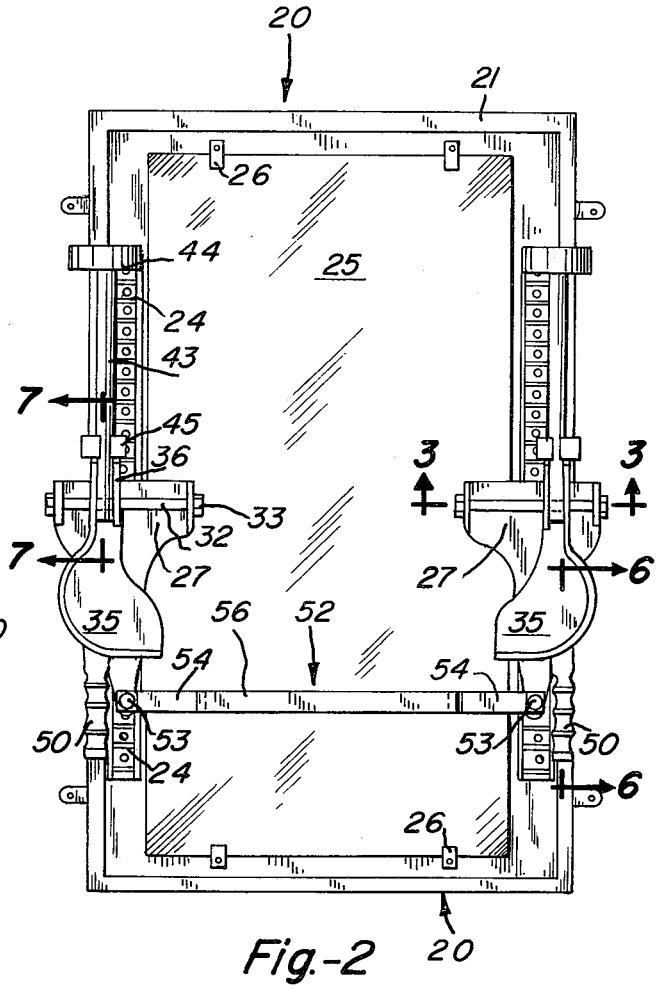
FIG. 2 is a front elevational view of the apparatus of FIG. 1.
Figure 3:
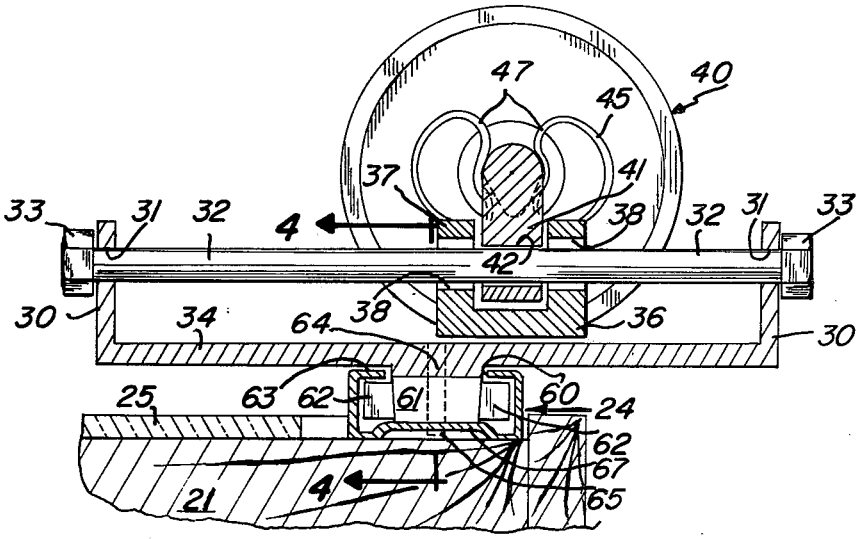
FIG. 3 is a sectional view taken along line 3—3 of FIG. 2.
Figure 7:
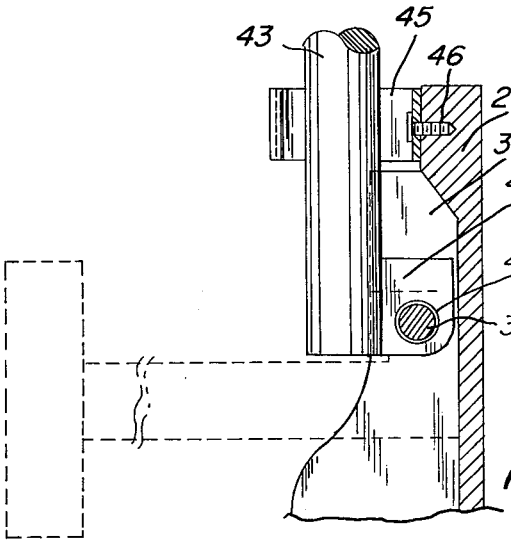
FIG. 7 is a sectional view taken along line 7—7 of FIG. 2.

A shoulder positioning arm member 40 is hinged to the pivot rod 32 of each carriage member 27 at a base portion 41 having a hole 42 formed therein for receiving the pivot rod 32 (FIGS. 3 and 7). Each shoulder positioning arm 40 comprises an extension 43 connected to the base portion 41 and a shoulder pad 44 connected to the extension 43. Each shoulder positioning arm 40 assumes the same lateral position along pivot rod 32 as the elbow cup members 33 due to maintenance of base portion 41 intermediate the outward projections 37 of the elbow cup member 35. As is shown best in FIGS. 3 and 7, a spring clip 45 is attached to the carriage member 27 by a screw 46, and the spring clip includes a spring retention socket means 47 for applying lateral restraining force on the extensions 43 when the shoulder positioning arm is in a vertical position shown in FIGS. 1 and 2, and for allowing each arm 40 to hinge outward and downward when the shoulder positioning arm member 40 is in use.

Figure 1:
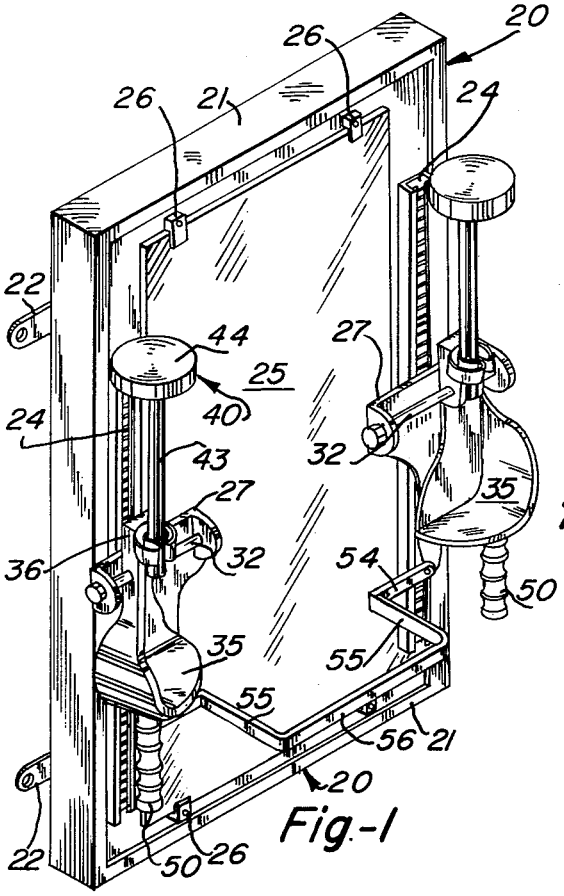
FIG. 1 is a perspective view of a preferred embodiment of apparatus according to the present invention.
Figure 6:
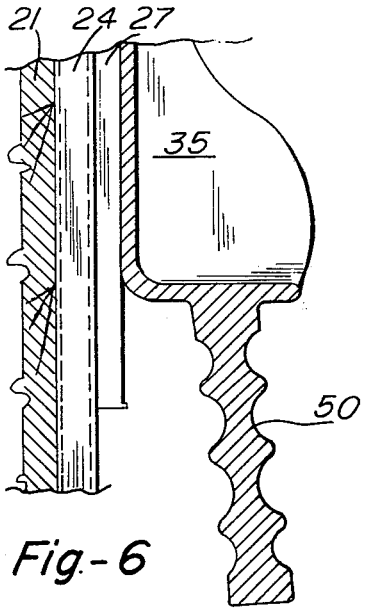
FIG. 6 is a sectional view taken along line 6—6 of FIG. 2.

One handgrip member 50 is attached to the bottom of each elbow cup member 35, as is shown in FIGS. 1, 2 and 6. It is desirable that each handgrip member 50 assume an angle with the vertical or upright wall-like surface of approximately 10° away therefrom (FIG. 6) to facilitate grasping it and for reasons to be apparent from the subsequent description of the method and operation of the present invention.

Figure 4:
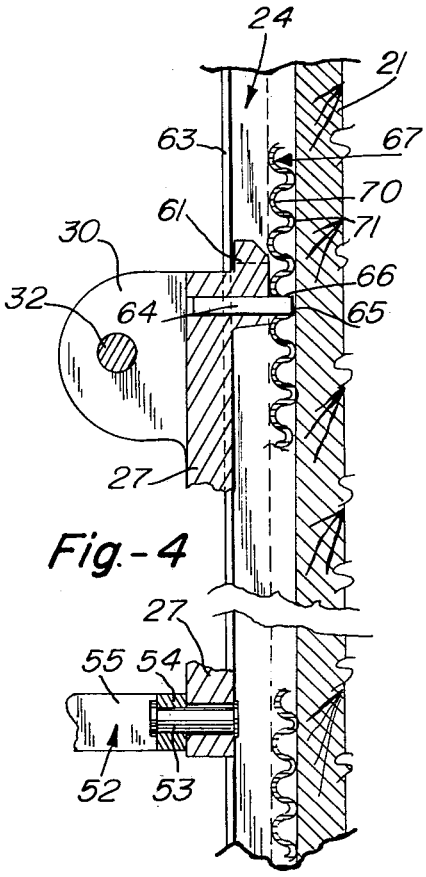
FIG. 4 is a sectional view taken along line 4—4 of FIG. 3.

A back reference bar member 52 is pivotally attached by pins 53 between the two carriage members 27 carried by the vertical slide members 24 on each side of frame member 21, as shown in FIGS. 1, 2 and 4. Reference bar 52 includes two end portions 54, two intermediate outward extending projections 55 and a center laterally extending portion 56. The ends 54 of reference bar 52 are maintained at a fixed distance below the elbow cups 35 due to the direct connection of the ends 54 to the carriage member 27. The pivotal connection between the ends 54 of back reference bar 52 and the carriage member 27 at pins 53 is provided to allow adjustment of each carriage member 27 to accommodate individuals having each shoulder of a slightly different height, as will be apparent from the subsequent description.

The carriage members 27 thus are each one form of means for operatively connecting the elbow cup members 35, the shoulder positioning members 40, the handgrip members 50 and the back reference bar 52 to the upright surface, as a result of the connection of the slide members 24 to the frame member 21 which is, in turn, attached by means 22 to the upright wall-like surface.

Adjustment means for retaining the carriage members 27 at selected vertical positions along the slide members 24 will now be described in conjunction with FIGS. 3, 4, 5 and 8. Each slide member 24 generally has a C-shaped cross section with a vertical opening 60 facing outward of the frame member 21 defined by laterally inward facing edge portions 63. The carriage member 27 has an inward projecting boss member 61 to which are attached lateral wing members 62. Wings 62 project laterally behind the edges 63 of each slide member 24 to prevent the carriage member 27 from moving outward of the slide member 24. A pin member 64 extends through the carriage member 27 and center of boss 61, and an end 65 thereof projects slightly through holes 66 in a center back wall portion 67 of the slide member 24. Shown in FIGS. 5 and 8, the slide member back wall portion 67 comprises a plurality of regularly vertically spaced outwardly protruding ribs 70 separated by valleys 71, thereby providing a corrugated or S-shaped cross section. The holes 66 are formed in the lateral center of each valley 71 for receiving the end 65 of pin 64.

Figure 5:
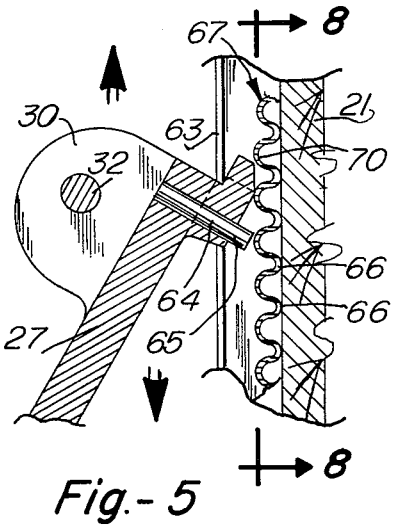
FIG. 5 is a partial view of FIG. 4 illustrating the operation of certain apparatus therein.
Figure 8:
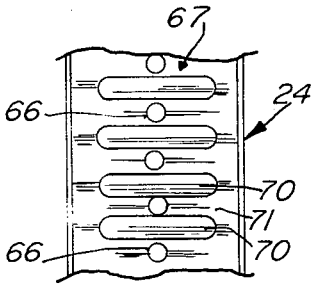
FIG. 8 is a sectional view taken along line 8—8 of FIG. 5.

In the position of use shown in FIG. 4, the carriage member 27 is retained in its vertical position by the protruding end 65 of pin 64 in hole 66 of the back wall portion 67 of the slide member 24. The wings 62 on boss 61 (FIG. 3) prevent the vertically upward end of the carriage member 27 from moving outward of the slide member 24. When it is desired to adjust the relative height position of one or both of the adjustable carriage members, the lower portion of the carriage member is rotated clockwise as shown in FIG. 5. The wings 62 of boss 61 contacting edges 63 causes a point of rotation for the carriage member allowing the protruding end 65 of pin 64 to be removed from hole 66. Once pin end 65 is free of the hole 66 the carriage member may be moved along the slide member until a desired vertical position is obtained, at which point the carriage member is rotated counter-clockwise (FIG. 5) causing pin end 65 to project into one hole 66 in the back wall portion 67 of the slide member 24 retaining the carriage member at the desired height. Thus the slide member 24 is one form of means for supporting the carriage member 27 at a plurality of vertical positions.

Figure 10:
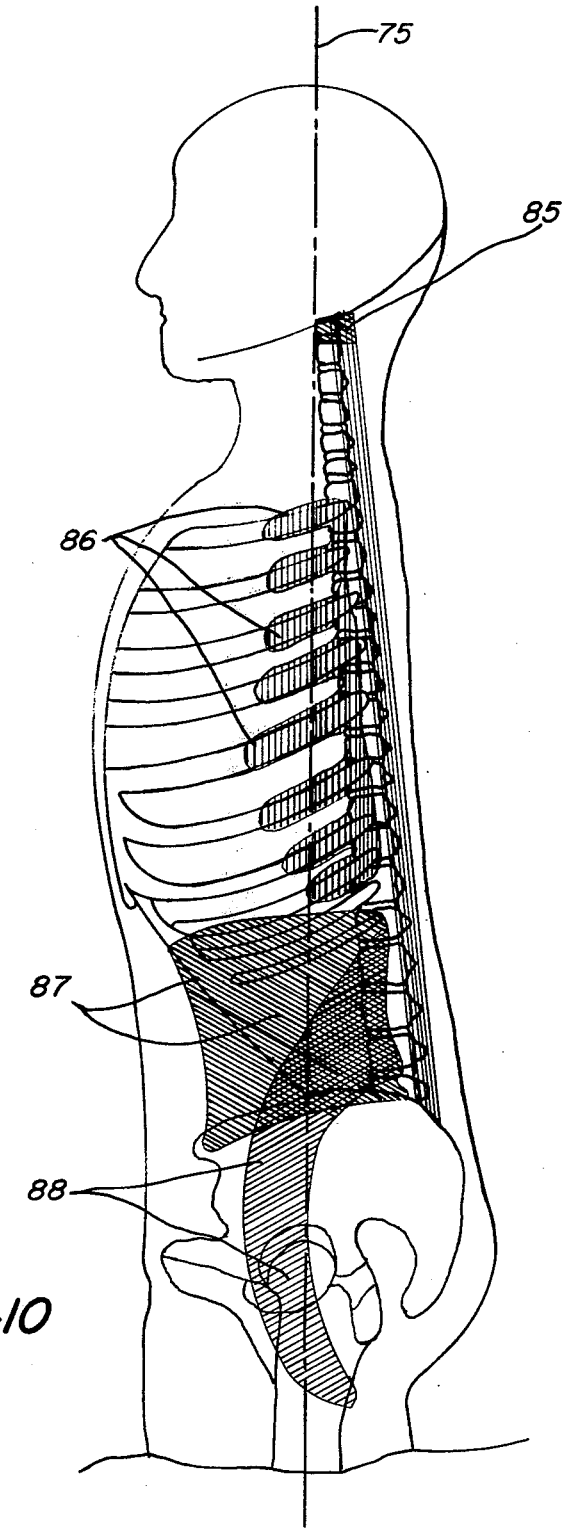
FIG. 10 is a schematic illustration of certain muscles and portions of the skeleton of a human body which are used during exercises to obtain proper posture and an erect and aligned spinal column according to the present invention.

The objective of the apparatus 20 of the present invention is to instill in the subconscious mind of an individual certain points of focus for properly relating the head and neck, the shoulder girdle, and the pelvic girdle to a centerline 75 or a gravity line through the thorax region of the body and through the body as a whole to thereby obtain the proper posture through an aligned and erect spinal column. Proper posture and an erect spinal column are shown in FIG. 10, and are defined relative to the centerline 75 extending through the body. This centerline 75 is the gravity line which passes approximately through the following points of the human skeleton: the posterior border of the ramus of mandible, shown at 76 which is approximately the same position as the anterior portion of the atlas or first cervical vertebrae; the acromium process of scapula and head of humerous, shown at 77; the olecranon process of ulna, shown at 78; the anterior superior iliac spines, shown at 79, the head of femur and acetabulum, shown at 80; the middle point between the base of femur and the top of tibia, shown at 81; and the lateral malleous and medial, shown at 82. In the erect and proper posture position shown in FIG. 10, the spinal column 83 is in an erect and aligned position not having the typical S-shaped curve. The base of the spinal column is off-center behind the centerline 75 or gravity line and slopes forward to where the top of the spine is on the centerline with the results being that the various internal organs and body parts are placed in a mutually beneficial relationship in the gravity field, thereby resulting in more healthful functioning of the body organs and parts.

To obtain an erect off-center segmented spinal column, three groups of key muscles must be conditioned to hold the spinal column erect without the typical S-shaped curvature. These key groups of muscles are shown in FIG. 10. The rectus capitus anterior group of muscles shown at 85 are deep inner muscles spanning from the first cervical vertebrae or atlas to the back base of the skull or occiput in front of foramen magnum, and are used to flex the head on the neck. The serratus magnus group of muscles, shown at 86, span from the vertebral border of the scapula or shoulder blades to the ribs and are used in projecting the head backwards and upwards over the thorax and in providing a fulcrum of support from which the shoulders move and rest upon. The internal obliques, shown at 87, and the psoas, shown at 88, are muscles which extend respectively from the lower ribs to the iliac crest and from the lumbar vertebrae to the lessor trochanter of the femur of the leg. The internal obliques and psoas are used to rotate the anterior superior iliac spines of the pelvic area backward about the acetabular or hip joints. By flexing the rectus capitus anterior muscles 85 the head and neck will be moved, and the head will move generally up and back from the shoulder girdle and the posterior border of the ramus of the mandible at 76 will generally be positioned at the gravity line 75. By flexing the serratus magnus muscles 86, the spinal column at the shoulder girdle will generally move backward, to center the shoulder girdle at the centerline 75 with the acromion process of scapula and head of humerus at 77 and olecranon process of elbows at 78 on the centerline. By flexing the internal oblique and psoas muscles, the anterior superior iliac spine at 79 of the pelvic girdle will move back to the gravity line 75. The result of such movement and conditioning is the proper body posture as illustrating in FIG. 10. The use and operation of the apparatus 20 of the present invention for conditioning these muscles to assume proper posture through an erect spinal column, as well as the method of the present invention, will now be described in conjunction with FIGS. 11, 12 and 13.

To begin use of the apparatus 20 the carriage members 27 are adjusted in the vertical slide members 24 according to the height and width of the individual's shoulders. The shoulder positioning arms 40 are disengaged from the spring clips 45 and rotated into their outward extending use positions shown in FIG. 13. The carriage members are adjusted in the vertical slide members until the shoulder pads 44 contact the individual's shoulder fronts. The arms 40 are rotated upward and retained in position by the spring clip after the initial adjustment, since this adjustment is the proper position for all subsequently described conditioning exercises.

Figure 11:
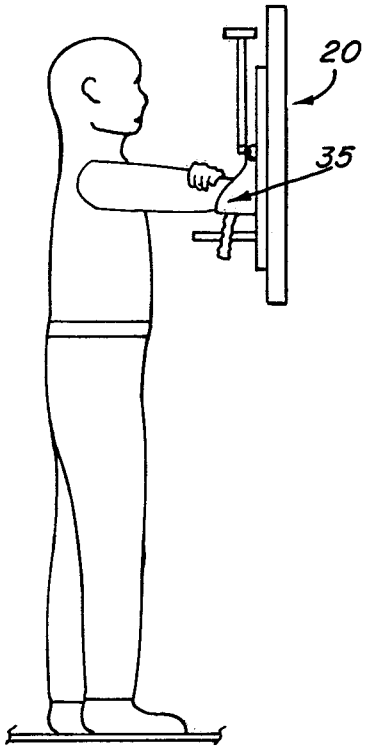
FIGS. 11, 12 and 13 are diagrammatic illustrations of the use of the apparatus shown in FIGS. 1 through 8 and diagrammatic illustrations of the method according to the present invention.

The first exercise shown in FIG. 11 is for the purpose of aiding conditioning of the muscles and points of focus for the head, neck, and shoulder girdle relative to the thorax of the individual or relative to the gravity line through the individual with proper posture. The first exercise is also useful in providing a reference focus similar to that in crawling, although now with the arms having the elbows in the elbow cup members as a reference from which to move instead of having hands on a crawling surface. The arms are extended from the shoulders and folded at the elbows with each hand touching the elbow of the opposite arm, and the elbows are placed in the elbow cup members 35. In this position the head is flexed on the neck and the posterior border of the ramus of the mandible is moved to the centerline. The head, neck and spinal column is moved backward away from the elbows in the elbow cup members, in a manner similar to that accomplished while crawling when the head and neck is moved away from the hands on the crawling surface. The serratus magnus muscle is the primary muscle in this exercise and the shoulder blades or scapula spread far apart and widen as this movement is accomplished. The waistline area or the anterior superior iliac spines of the pelvic girdle are moved backward toward the centerline after the head, neck and spinal column have been moved as described. In this position the serratus magnus muscles are worked through their full range of motion to instill in the subconscious mind the reference and focus for the proper alignment of the spinal column while the head, neck and pelvic girdle are maintained in their desired positions.

Figure 12:
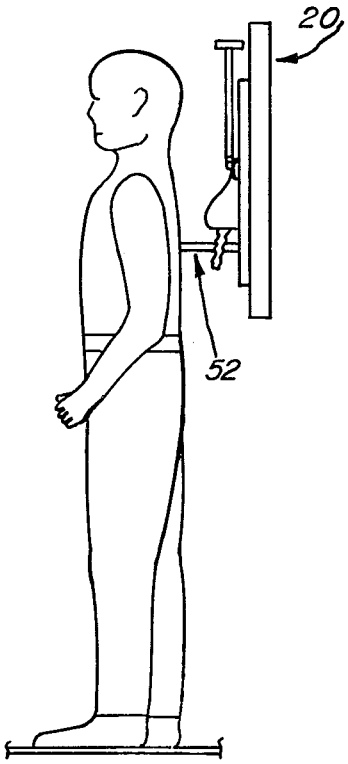

The second exercise shown in FIG. 12 is for aiding conditioning of a focus reference for the neck, head, shoulder girdle and pelvic girdle relative to the thorax of the individual and to a gravity line through the individual with proper posture. The second exercise is also useful for aiding conditioning of the proper alignment of all portions of the spine itself in an erect configuration. In this position the individual's back at a position approximately below the base of the scapula is placed against the reference bar 52 which is in a proper position due to the initial adjustment of the carriage members 27. Here the head is flexed on the neck and moved backward and upward away from the shoulder girdle. The back of the head or the external occipital protuberance is moved vertically above the reference bar 52. The elbows move in front of the reference bar and the pelvic girdle or anterior superior iliac spines are rotated backward vertically below the reference bar. These movements assist in relating the various portions of the spinal column to itself in the erect configuration of an off-center segmented column. In the second exercise the head and neck experiences full balanced movement and assumes a conditioned position over the centerline through the individual and the entire spine is generally straightened and aligned in relation to itself.

Figure 13:
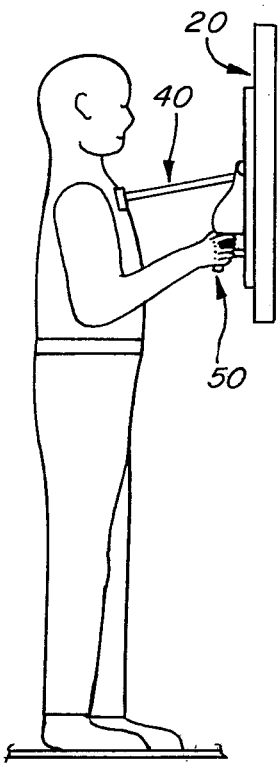

The third exercise shown in FIG. 13 is for aiding conditioning of the point of reference for the pelvic girdle relative to the thorax and centerline through the individual, as well as combining the reference points of focus for the head neck and shoulder girdle to the centerline. The shoulder positioning arms 40 are rotated downward and outward and the individual's shoulder fronts are placed against the shoulder pad members. The individual grasps the handgrips 50, flexes the head on the neck and moves the head to its upward and backward position, moves the spinal column away from the shoulder girdle by moving head and neck away from the shoulder fronts against the pads on the shoulder conditioning arms 40, and moves the pelvic girdle backward in the desired manner while pulling downward on the handgrips 50. The downward pulling movement on the handgrips assists the individual in moving the anterior superior iliac spines back to the centerline, and exercises the internal obliques and psoas muscles. The angle of the handgrips 50 with respect to the vertical causes the downward pulling movement by the hand to conform to a line extending through the handgrips directed toward the pelvic girdle at the anterior superior iliac spine. This angle of force further aids the flexing of the internal oblique and psoas muscles through a full range of movement to cause the anterior superior iliac spine to assume a conditioned position over the centerline through the body. The handgrips bring the internal oblique and psoas muscles into conscious and then unconscious or habitual use, and coordinate these muscles with the other key muscles in movement. The handgrip members are essential for developing muscles coordination and control such as that prevalent in the cross-crawl movement, as will next be described in conjunction with FIGS. 11, 12 and 13.

Aiding of the transferring of the muscle control prevalent in a cross-crawl movement to the erect biped or standing position is obtained in conjunction with the previously described three exercises by placing one foot transversely forward with respect to the other foot and supporting the majority of the body weight on the backward foot. Each exercise and position is repeated with the alternate foot in front. In the exercise described in conjunction with FIG. 11, the elbow of the arm on the side of the body opposite the forward foot serves prmarily as a reference for moving the back and spinal column away from the elbows, and in this manner the cross-crawl coordination and control of body movements is instilled into the conditioning of proper posture. In the exercise described in conjunction with FIG. 12, the backward foot serves as a secondary reference in conjunction with a primary reference from the reference bar 52 for alignming the spinal column. In the exercise described in conjunction with FIG. 13, only one handgrip at a time is gripped with the hand of the arm on the side of the body opposite the forward foot to most accurately simulate a cross-crawl movement. The cross-crawl movement is recognized for instilling a peaceful and proper coordination in control of body movement. In the crawling position the spinal column is normally aligned and the head, neck and chest, abdomen and lower back are supported by the key muscle groups described herein, especially the serratus magnus muscle. Thus, additional conditioning of cross-crawl coordination and control may be achieved as well as proper posture.

From the foregoing description it is apparent that the elbow cup member 35 is one form of means adapted for supporting the bent elbows of a standing or erect person with the arms extended forward and each hand touching the elbow of the opposite arm. The shoulder positioning member 40 is one form of means adapted for engaging the shoulder fronts of the person a predetermined distance outward from the elbow cup members. The handgrip member 50 is one form of means adapted for gripping by the hand of the person below the elbow cup member with the shoulder fronts abutting member 40 and with the upper arm extending generally downward from the shoulder and the lower arm extending generally forward from the elbow. The back reference bar 52 is one form of means adapted for engaging the person's back at a position in the shoulder girdle below the elbow cup member and below the level of the person's shoulders.

The method and apparatus of the present invention has been described in conjunction with a preferred embodiment so as to enable an understanding of the invention. It should be understood that the inventive subject matter of the invention is intended to be limited only insofar as the prior art requires.

What is claimed is:

1. Apparatus for aiding conditioning of muscles in the head, neck, shoulder girdle and pelvic girdle of an individual person to obtain an erect and aligned spinal column, comprising:

elbow cup means adapted for supporting the bent elbows of an erect person with the arms extended forward and each hand touching the elbow of the opposite hand, said elbow cup means also comprising means for operatively connecting the elbow cup means to an upright wall-like surface;

shoulder positioning means adapted for engaging the shoulder fronts of the erect person a predetermined distance outward from said elbow cup means and away from the upright surface, said shoulder positioning means also comprising means for operatively connecting the shoulder positioning means to the upright surface at a position generally above said elbow cup means; and handgrip means adapted for gripping by the hand of the erect person below the elbow cup means when said elbow cup means are not being used and with the shoulder fronts abutted against said shoulder positioning means and with the upper arm of the gripping hand extending generally downward from the shoulder, and the lower arm of the gripping hand extending generally forward from the elbow, said handgrip means also comprising means operatively connecting the handgrip means to the upright surface at a position generally below said elbow cup means.

2. Apparatus as recited in claim 1 further comprising:

back referencing means adapted for engaging the back of the erect person at a position at the shoulder girdle, said back referencing means also comprising means for operatively connecting the back referencing means to the upright surface at a position generally below said elbow cup means to provide the position of engagement at the shoulder girdle generally below the level of the shoulders of the person.

3. Apparatus as recited in claim 2 further comprising:

carriage means for operatively connecting said elbow cup means, said shoulder positioning means, said handgrip means and said back referencing means to the upright wall-like surface.

4. Apparatus as recited in claim 3 further comprising:

slide means for supporting said carriage means at a plurality of vertical positions; and adjustment means associated with said slide means and said carriage means for retaining said carriage means at a selected vertical position along said slide means.

5. Apparatus for aiding conditioning of muscles between the head, neck, shoulder girdle and pelvic girdle of an individual person to obtain an erect spinal column, comprising:

at least one vertically extending slide member including means for operatively attaching said slide member generally vertically to an upright surface;

a carriage member mounted for movement along the vertical slide member and including means for retaining said carriage member at any one of a plurality of selected vertical positions along said slide member;

an elbow cup member connected to said carriage member outward of the upright surface;

a shoulder positioning arm pivotably connected to said carriage member above said elbow cup member; and a back reference bar member operatively connected to said carriage member below said elbow cup member.

6. Apparatus as recited in claim 5 further comprising:

a handgrip member operatively connected to said carriage member below said elbow cup member.

7. Apparatus as recited in claim 6 wherein said handgrip member is angled with respect to the upright surface.

8. Apparatus as recited in claim 7 wherein:

two parallel vertical slide members are provided in a laterally spaced apart relation;

one carriage member is mounted for movement in each slide member;

one elbow cup member and one shoulder positioning member and one handgrip member are operatively attached to each carriage member; and said back reference bar member extends laterally between said carriage members.

9. Apparatus as recited in claim 8 wherein each of said handgrip members is angled with respect to the upright surface.

10. Apparatus as recited in claim 8 wherein said back reference bar includes a laterally extending center portion spaced outward from said carriage member and said upright surface.

11. Apparatus adopted to be connected to an upright wall-like surface for aiding conditioning proper posture of an individual person, comprising:

a vertically extending slide member adopted to be operatively attached to the upright surface, said slide member comprising:

an outward facing and vertically extending opening defined by two laterally spaced apart edge portions laterally projecting toward one another, and a back wall portion extending vertically along and spaced behind the vertically extending opening, the back wall having a plurality of holes formed therein;

means adapted for contacting a body part of an erect person during a posture conditioning exercise, and carriage means for operatively attaching said body part connecting means to said slide member, said carriage means comprising:

a boss member generally projecting into the outward facing vertical opening at the slide member, at least one wing member attached to the boss member and extending laterally behind at least one edge portion at the slide member, and a pin member projecting through the outward facing vertical opening to fit within a hole in the back wall portion of said slide member.

12. A method of aiding conditioning of proper body posture by relating the head, neck, shoulder girdle and pelvic girdle of an individual person to a centerline through the person for obtaining an erect off-center spiral column, comprising the steps of:

supporting the bent elbows of a standing person in elbow supporting means with the upper arms extended forward from the shoulders, the lower arms extended toward the bent elbow of the opposite arm, and each hand touching the elbows of the opposite arm;

moving the head upward and backward over and away from the shoulder girdle, and the pelvic girdle backward about its lower hip joint portion, all with the bent elbows supported;

next abutting the shoulder fronts of the standing person on shoulder positioning means;

gripping a handgrip by at least one hand of the standing person with the upper arms extended downward from the shoulder, the elbow bent, and the lower arms extended forward while the shoulder fronts abut the shouler positioning means;

pulling downward with the hand gripping the handgrip; and moving the head and neck and the pelvic girdle in the previously recited manner, all with the hands gripping the handgrips and the shoulder fronts abutting the shoulder positioning means when pulling downward with the hand.

13. A method as recited in claim 12 further comprising:

supporting the back of the standing person on a back reference means extending generally across the shoulder girdle below the shoulders; and moving the head and neck and pelvic girdle in the previously recited manner, all with the back supported.

14. A method as recited in claim 13 further comprising:

placing one foot of the standing person transversely forward with respect to the other foot.

15. A method of aiding conditioning of the relationship of the head and neck, the shoulder girdle, and the pelvic girdle to a centerline through an erect individual's body to obtain an erect spinal column, and further for the purpose of aiding transferring muscle control prevalent in a cross-crawl movement to the erect biped position, comprising the steps of:

providing means adapted for supporting the elbows of an erect individual with the upper arms extended forward from the shoulders, extending the arms of an erect individual forward from the shoulders, supporting the elbows of the forward extending arms in the elbow supporting means, placing one foot transversely forward with respect to the other foot, supporting the majority of the body weight on the backward foot.

moving the back and spinal column at the shoulder girdle away from the elbows in the elbow support means by flexing the serratus magnus muscles, and using the elbow of the arm on the side of the body opposite the forward foot primarily for moving the back and spinal column away from the supported elbows.

16. A method as recited in claim 15 further comprising the steps of:

moving the head and neck by flexing the rectus capitus anterior muscles to generally move the head up and back from the shoulder girdle to generally position the posterior border of the ramus of the mandible at the centerline, and moving the anterior superior iliac spines of the pelvic girdle back toward the centerline by flexing the internal obliques and psoas muscles.

17. A method of aiding conditioning of the relationship of the head and neck, the shoulder girdle and the pelvic girdle to a centerline through an erect individual's body to obtain an erect spinal column, comprising the steps of:

providing means adapted for abutting the shoulder fronts of an erect individual, providing means adapted for gripping by the hand of an arm with the upper arm extending generally downward from the shoulder and the lower arm extending generally forward from the elbow, abutting the shoulder fronts of an erect individual on the shoulder front abutting means, gripping the handgrip means with a hand of an arm of the erect individual while the individual's shoulders are abutting the shoulder front abutting means, moving the anterior superior iliac spines of the pelvic girdle back to the centerline by flexing the internal obliques and psoas muscles, and pulling downward on the hand grip means simultaneously with the moving of the anterior superior iliac spines.

18. A method as recited in claim 17 for the further purpose of aiding transferring muscle control prevalent in a cross-crawl movement to the erect biped position, comprising the steps of:

placing one foot transversely forward with respect to the other foot, supporting the majority of the body weight on the backward foot, gripping the hand grip means only with the hand of the arm on the side of the body opposite the forward foot.

19. A method as recited in claim 17, further comprising the step of:

moving the head and neck by flexing the rectus capitus anterior muscles to generally move the head up and back from the shoulder girdle to position the posterior border of the ramus of the mandible at the centerline.

20. A method as recited in claim 19 further comprising the step of:

moving the back and spinal column at the shoulder girdle backward away from the shoulder front abutting means.

21. A method as recited in claim 20 further for the purpose of aiding transferring muscle control prevalent in a cross-crawl movement to the erect biped position, comprising the steps of:

placing one foot transversely forward with respect to the other foot, supporting the majority of the body weight on the backward foot, and gripping the hand grip means only with the hand of the arm on the side of the body opposite the forward foot.

* * * * *